US006808173B2

(12) United States Patent
Snow

(10) Patent No.: US 6,808,173 B2
(45) Date of Patent: Oct. 26, 2004

(54) BLACKJACK GAME WITH SIDE WAGER ON DISPLAYED CARDS

(75) Inventor: Roger M. Snow, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 0 days.

(21) Appl. No.: 10/272,407

(22) Filed: Oct. 15, 2002

(65) Prior Publication Data

US 2004/0070146 A1 Apr. 15, 2004

(51) Int. Cl.[7] ..... A63F 1/00

(52) U.S. Cl. ..... 273/292; 273/274; 273/309; 463/12

(58) Field of Search ..... 273/292, 274, 273/309, 138.2; 463/12

(56) References Cited

U.S. PATENT DOCUMENTS

| | | | | | |
|---|---|---|---|---|---|
| 4,861,041 | A | * | 8/1989 | Jones et al. | 273/292 |
| 5,174,579 | A | * | 12/1992 | Griffiths | 273/292 |
| 5,275,416 | A | * | 1/1994 | Schorr et al. | 273/292 |
| 5,288,077 | A | | 2/1994 | Jones | 273/292 |
| 5,364,105 | A | | 11/1994 | Jones | 273/292 |
| 5,377,973 | A | | 1/1995 | Jones et al. | 273/85 C |
| 5,397,128 | A | * | 3/1995 | Hesse et al. | 273/292 |
| 5,454,570 | A | * | 10/1995 | Karal | 273/292 |
| 5,577,731 | A | | 11/1996 | Jones | 273/292 |
| 5,632,485 | A | * | 5/1997 | Woodland et al. | 273/292 |
| 5,636,842 | A | * | 6/1997 | Cabot et al. | 273/292 |
| 5,673,917 | A | * | 10/1997 | Vancura | 273/292 |
| 5,725,216 | A | | 3/1998 | Jones | 273/292 |
| 5,743,532 | A | * | 4/1998 | Lafferty | 273/292 |
| 5,816,575 | A | * | 10/1998 | Keller | 273/292 |
| 5,839,730 | A | * | 11/1998 | Pike | 273/292 |
| 5,934,675 | A | * | 8/1999 | Handelman et al. | 273/292 |
| 5,979,897 | A | * | 11/1999 | Grossman | 273/292 |
| 6,000,699 | A | * | 12/1999 | Long | 273/292 |
| 6,012,719 | A | * | 1/2000 | Webb | 273/292 |
| 6,019,374 | A | * | 2/2000 | Breeding | 273/292 |
| 6,095,525 | A | * | 8/2000 | Terminel | 273/274 |
| 6,113,102 | A | * | 9/2000 | Marks et al. | 273/292 |
| 6,158,741 | A | * | 12/2000 | Koelling | 273/292 |
| 6,227,969 | B1 | * | 5/2001 | Yoseloff | 463/13 |
| 6,322,075 | B1 | * | 11/2001 | DeFranco | 273/274 |
| 6,334,614 | B1 | * | 1/2002 | Breeding | 273/292 |
| 6,341,778 | B1 | * | 1/2002 | Lee | 273/292 |
| 6,371,867 | B1 | * | 4/2002 | Webb | 473/292 |
| 6,386,973 | B1 | * | 5/2002 | Yoseloff | 463/13 |
| 6,394,456 | B1 | * | 5/2002 | Long | 273/292 |
| 6,450,500 | B1 | * | 9/2002 | Miller | 273/292 |
| 6,481,718 | B2 | * | 11/2002 | Koelling | 273/292 |
| 6,523,829 | B1 | * | 2/2003 | Walker et al. | 273/292 |
| 6,540,230 | B1 | * | 4/2003 | Walker et al. | 273/292 |

OTHER PUBLICATIONS

R. Brooke Dunn—Method of Playing a Table Card Game with an Electronic Multiplier Bonus Feature and Apparatus for Playing the Game—Dec. 26, 2002—Pub. No.: US 2002/0195773 A1.*

Yoseloff et al.—Method of Playing a Table Card Game with an Electronic Multiplier Bonus Feature and Apparatus for Playing the Game—Jun. 20, 2002—Pub. No.: US 2002/0074726 A1.*

* cited by examiner

*Primary Examiner*—Derris H. Banks
*Assistant Examiner*—D Collins
(74) *Attorney, Agent, or Firm*—Mark A. Litman & Associates, P.A.

(57) ABSTRACT

An underlying game of Blackjack or a variant of Blackjack is played with an initial wager by a player on the underlying game and an optional wager on a side game can be made. The side wager is made before any cards are displayed. The side wager is made on whether a specific rank of card will be shown in either of the two player's cards (the player who has made the wager) or in the dealer's exposed card. The probabilities of a specific rank of a card (as opposed to value of card, which would render 10's, Jacks, Queens and Kings equivalent) is the same, whichever card is selected, but a preferred game from an advertising standpoint, marketing standpoint or the like is the use of Jacks, with the game titled Jack Magic™ blackjack or Jacks Magic™ blackjack. The player places a wager on an identified wager area, and after the player's cards and the dealer's cards have been dealt, the wager is resolved according to the rules of the game. The regular play of the Blackjack game is then continued, with no change in the underlying strategy of the game.

14 Claims, No Drawings

BLACKJACK GAME WITH SIDE WAGER ON DISPLAYED CARDS

BACKGROUND OF THE INVENTION

1. Field of the Invention

The present invention relates to card games, particularly to blackjack card games and its variants and more particularly to an underlying Blackjack card games and variants with side bets on events that do not influence the underlying strategies in the play of the underlying Blackjack game.

2. Background of the Art

Card games have always been popular as wagering games. The history of card games reaches back into biblical eras. One of the most popular card games, especially for gambling or gaming uses is the card game known as Blackjack (or "21") wherein a blackjack player plays against a dealer and the object is to beat the dealer's hand by reaching a total point value closest to 21, without exceeding a point count of twenty-one and/or by having the dealer's point count exceed twenty-one. The player may exercise strategies including adjusting his point count either by maintaining his original cards and card count (e.g., referred to as "standing," not drawing a card that might cause the Blackjack player to 'bust, that is go over 21) and hope that the dealer will bust or by accepting additional cards (referred to as 'hitting' or 'taking a hit'), attempting to receive a cumulative point card total higher (not exceeding a total point count of 21) than the total point count that the Dealer will ultimately attain. If both the Blackjack player and the dealer each achieve a point count total that does not exceed 21, then the highest total (as between individual players and the dealer) wins the bet. Blackjack is relatively simple to understand and is usually a faster and easier card game to play than, for example, the game of Poker, therefore Blackjack, which can be played with the dealer and only one Blackjack player, tends to be more popular than the conventional game of Poker which needs to be played with several players because each of the Poker players are competing against each other for one pot whereas each Blackjack player can win against the one dealer. Even with variants of poker being played in casinos (e.g., Let It Ride® poker, Three Card Poker®, Crazy 4 Poker™, Caribbean Stud® poker, etc.), Blackjack remains the most popular card game in casinos, with many more tables usually dedicated to blackjack than to all other card games combined.

Blackjack must include a dealer (in mechanical, electromechanical, electronic or video versions of the game, a virtual dealer's hand is provided) and there must be at least one Blackjack player. One or more Blackjack players playing against the Dealer are, in effect, individually competing to try to either obtain a better total card point count than the point count of the dealer, without exceeding a total point count in the player's hand of 21 (for the total number of multiple playing cards that they the dealer is dealt). The player may stand after receiving a minimum of 2 cards and hope that the Dealer will bust. There are many variants on strategies that are used in the play of cards that are dependent upon a consideration of the player's cards in comparison with the dealer's cards. There are preferred and optimal strategies that may be used, with some strategies possibly influenced by card counting by the player.

For example, Blackjack players seeing a dealer's exposed card as a 2, 3, 4, 5 or 6, will themselves elect to take no hits when the player's point count is 12, 13, 14, 15 or 16 in the hopes that the dealer's hitting (which is required when the dealer's point count is 16 or less) will result in a bust. The objective of the player is that with the exposed card being generally incapable of having a starting point count where the dealer may stand (the exception being a disclosed card of a 6 and a hole card of an ace), the dealer will take hits to a point total that exceeds 21 and therefore break (or "bust"), allowing the player to win the hand. The player will win the bet if the dealer has to hit (the Dealer is required to draw if their point total is 16 or less) and the Dealer busts (goes over 21). Blackjack players also have the option of splitting any pairs (i.e., a pair of cards of identical point count value, such as two face cards, a 10 and a face card, a pair of 10s, a pair of 9s, a pair of 3's, etc.). Blackjack players have several options such as to double down (double their bet and receive only one more card), double their bet when they split a pair of cards, and can receive a 1.5 times their bet return if they receive an Ace and a 10 or picture card for their other card. A Blackjack player receiving a card score of more than 21 points has a bust hand and automatically loses to the dealer. If the dealer accumulates cards with a point count in excess of 21, the dealer busts, and every player remaining in the game (those players who have not busted themselves) wins the hand. The dealer, after receiving the first 2 cards begins drawing one or more cards (if the first 2 cards are 16 or less), but only after each of the Blackjack players at the dealer's table have played their hands to completion. Therefore, the house or casino has the advantage because the Blackjack player or players must play and complete their hand first or before the dealer plays or completes his hand. The Blackjack players at the table individually play against the dealer. The dealer must receive a minimum of 2 cards and attain a point count of at least 17 before the dealer may stop taking cards. Each of the Blackjack players individually playing against the dealer (who is a representative of the house or casino) has the option of standing after the receipt of their 2 initial cards. This means that the player will have the options of not receiving any other cards or to draw one or more other cards from the dealer and to continue drawing cards until the player is either satisfied with their card count score and stops drawing cards (stands) or the player has busted (gone over the 21 point total). As is known in the Blackjack card game, picture cards (Jacks, Queens and Kings) each have a point card value of 10 points while Aces have a point card value of either 1 point or 11 points. The other cards namely 2s, 3s, 4s, 5s, 6s, 7s, 8s, 9s and 10s have a point card value equivalent to their face card value (i.e., respectively 2, 3, 4, 5, 6, 7, 8, 9, and 10). In most gaming or casino establishments, dealers have to draw when they receive a point card value of 16 or less and, in some Casinos or gaming establishments, when they receive a point card value of 17 or less where the 17 point card value is based upon using an Ace as an 11 point card value with one or more other cards (this is known as a soft 17).

While Blackjack or 21 is a relatively fast-playing card game, it is always desirable to offer the players opportunities for variations in the game to maintain their long-term interest. Other betting options are desirable for the Blackjack player other than just varying the size of their wagers. Thus a Blackjack game is needed which would permit the Blackjack player to have a chance to win a large bet (as a regular option or an option after losing a number of conventional bets to the dealer) without the risk of losing a large bet that was the only previous option to try to promptly recoup a series of lost bets to the Dealer.

Attempts have been made to vary the game of Blackjack to a relatively minor degree wherein a Blackjack player could have more than one betting option other than the Blackjack player's bet to receive a higher card total not more than the maximum of 21 than the Dealer or to hope that the Dealer busts. However, these other attempts have not been successful because they do not provide a multitude of very exciting betting options combined with a large jackpot type of payout. U.S. Pat. No. 5,454,570 to Karal discloses a Blackjack card game method therein a Blackjack player has extended wagering opportunities after the Blackjack player's hand has reached a desired card count value. Specifically, the Blackjack player can bet on whether the Dealer will achieve a card count that would be higher (but not greater than 21) than the Blackjack player's hand. This supplemental bet or wager by the Blackjack player is prior to the Dealer revealing the Dealer's face down card. Predetermined odds on the different possible Dealer hand combinations are selected by the Blackjack player by the selection of the point card value of the Dealer's hand. Also, the Blackjack player can wager on the point card value of the Dealer's only face down card. Furthermore, the Blackjack player can bet on the point card value of the third Dealer card, etc. The odds presented in this U.S. Patent range from 10 to 1 (on an Ace being the Dealer down card or the next card to be drawn by the Dealer). Picture cards including 10s have a 2 to 1 betting ratio.

U.S. Pat. No. 5,275,416 to Schorr et al. also discloses a Blackjack card game method wherein a Blackjack player can bet on the Dealer's hand, the Blackjack player's hand or for a tie in the point count between the Dealer and the Blackjack player. The bet for the tie pays 9 to 1, the bet for the Blackjack player's hand is even money (1 for 1), and the bet on the Dealer's hand is 5 for 6 (five chips can be won on a 6 chip bet).

U.S. Pat. No. 5,174,579 to Griffiths discloses a Blackjack card game method wherein a separate bet can be made on whether the dealer obtains exactly 21 or busts. Disclosed therein is a discussion of Royal Match 21 involving a separate bet by the Blackjack player to have their 2 initial cards be of the same suit (i.e. clubs, diamonds, hearts and spades). A higher payout is for when the Ace and King is received by the Blackjack player in the same suit for the 2 initial cards, but there is no separate bet for the receipt of these two cards (only a payout if they happen to be received when a bet is made for the receipt of 2 initial cards of the same suit). Also disclosed therein is a reference to the U.S. Pat. No. 4,861,041 to Jones et al. wherein a separate bet on a blackjack game is made to be eligible for certain specific jackpot hands (i.e., four 5s and an Ace or Ace, Two, Three, Four, Five and Six). Simply stated, prior attempts at providing more than one betting option to the Blackjack player did not give the Blackjack player an opportunity to bet and win a very large bonus (i.e. more than a thousand chips for each chip bet) as well as to bet on many different possible combinations that would pay more than a one chip payback for each one chip bet, but yet still provide the Blackjack player with, if desired, a straight bet to beat the dealer.

U.S. Pat. No. 5,816,575 describes a variant of Blackjack (21) game, in which a table and method is disclosed wherein a number of betting options are provided for the Blackjack player. In addition to the standard betting option against the dealer, a dealer Bust option, a jackpot option where the Blackjack player can obtain over 1,000 to 1 return payout and several other betting options are provided to bet on various possible cards such as receiving a 3 or a 6, a 4 or 5, a 10, Jack Queen, King or Ace for one or both of the initial two cards. The method of playing Blackjack against a dealer comprises the steps of providing a Blackjack player with a jackpot betting option to make a bet and have a possibility of winning more than one thousand times the bet made by the Blackjack player; and providing the Blackjack player with additional separate betting options to make a bet on receiving at least one card from an initial two cards received by the Blackjack player equal to one of a 4 and 5, one of a 3 and 6 and a selected one of a 10, a Jack, a Queen, a King and an Ace.

U.S. Pat. No. 5,839,730 describes a method for a wagering game is achieved by providing a side bet opportunity during the play of a Twenty-One game. The player is given the opportunity to place this side bet with the hope of receiving winnings when certain predetermined card configurations are received. Upon receipt of these defined card configurations, the player is immediately paid winnings during the process of the Twenty-One game. These additional winnings are based on sequences of cards and are independent and separate from wagers in the Twenty-One game. Additionally, all of the predetermined card configurations are preferably chosen such that they will not interfere with the underlying Twenty-One game. As a basis for paying out winnings, it is required that the player consecutively receive these certain card configurations during the play of the Twenty-One game after having made a bet in expectation of those card configurations appearing. Also, the final configuration of the Twenty-One hand is irrelevant to the side bet game as the players win immediately when the predetermined configurations are received, long before completion of the hand. In particular, the player's receiving of identical value cards in sequence is awarded bonus amounts when a side wager is placed.

U.S. Pat. No. 6,012,719 describes a card game that combines the play of Blackjack ("21") with a 3-card Poker wager or side bet ("21+3"). Each player places a basic Blackjack wager and an optional 3-card Poker wager before the cards are dealt. Each player is then dealt a card with the dealer receiving a face-up card. Each player is dealt a second card. At this point, the outcome of each 3-card Poker hand is determined, where a player's 3-card Poker hand consists of the 2-card hand dealt to that player and the dealer's face-up card. After settling the Poker wagers, the game of Blackjack continues in a typical fashion. The invention advantageously retains all the features and advantages of Blackjack as well as provides the dynamics of 3-card Poker, without interfering with the card sequence, for enhanced player anticipation and enjoyment.

Over-Under 13 is a side bet game in which a player may place an "over 13" or an "under 13" side bet on a blackjack hand. The player may bet that the player will have an initial two card hand under or over the point count of 13. This side bet game is widely used in casinos in the United States.

D.E.Q. Casinos, Ltd. markets a game known as "Luck Jacks & Queens™" which is played in conjunction with a side bet in a standard blackjack game. Regular blackjack rules apply, and an optional side bet for the side game is made. Combinations of a Jack and a Queen on the first two cards wins a randomly selected prize amount. Suited Queen and Jack combinations on the first two cards can win multiples of the randomly selected prize amounts. The random amount is selected and displayed on a meter attached to the table. There is no pay table.

In spite of the success of some of these card games, there is always a need to provide additional alternative for players.

SUMMARY OF THE INVENTION

An underlying game of Blackjack or a variant of Blackjack is played with an initial wager by a player on the underlying game and an optional wager on a side game can be made. The side wager is made before any cards are displayed. The side wager is made on whether a specific rank of card will be shown in either of the two player's cards (the player who has made the wager) or in the dealer's exposed card. The probabilities of a specific rank of a card (as opposed to value of card, which would render 10's, Jacks, Queens and Kings equivalent) is the same, whichever card is selected, but a preferred game from an advertising standpoint, marketing standpoint or the like is the use of Jacks, with the game titled Jack Magic™ blackjack or Jacks Magic™ blackjack. The player places a side wager on an identified wager area, and after the player's cards and the dealer's cards have been dealt, the side wager is resolved according to the rules of the game. The regular play of the Blackjack game is then continued, with no change in the underlying strategy of the game. The Jack Magic™ blackjack game may be played with certain tolerable variations. For example, when a player splits a hand (with or without any Jacks displayed in the player's hand or the dealer's hand), the house rules may control whether the play of Jack Magic™ blackjack continues, or whether the side bet is cancelled with only the first two cards displayed. The Jack Magic™ blackjack game may also be played where only the first card dealt with a split may be active in the side bet game. These variations significantly affect the payouts, the hold, and the odds in the game, so with each variation in the rules, different odds and different payout tables would have to be provided. The preferred method of play would be for the Jack Magic™ game being played on only the first two exposed cards dealt to the player and the dealer's single exposed card.

A general description of the play of the game of the invention can be provided as a method of playing a wagering card game comprising an underlying card game and an auxiliary card game comprising: placing at least one wager on the underlying card game; optionally placing a wager on the auxiliary card game; dealing a first number of cards to a player; dealing a second number of cards to the dealer; displaying at least one of the player's cards; displaying at least one of the dealer's cards;

wherein if at least one of the displayed player's cards or at least one of the displayed dealer's cards is a card of a specific predetermined rank, paying a player who has placed the optional wager for the occurrence of the at least one card of a specific predetermined rank being displayed in either the exposed card(s) of the dealer's hand and/or the player's hand; and then continuing deal of cards according to the rules of the underlying game and continuing play of the underlying game. The method is preferred where the underlying game comprises blackjack. The first two cards dealt to the player are usually displayed.

Usually only one card dealt to the dealer is displayed and the first card displayed by the dealer is used in ascertaining awards in the game. The method is preferred wherein paying a player who has placed the optional wager is based on a pay table based on the appearance of cards of specific rank on only displayed player's cards and a first displayed dealer's card.

Examples of pay tables for this method of play in the Jack Magic™ blackjack game are shown below.

| Four Decks | JM4-01 | JM4-02 | JM4-03 | JM4-04 |
|---|---|---|---|---|
| 3 one-eyed Jacks | 500 to 1 | 500 to 1 | 500 to 1 | 500 to 1 |
| 3 Jacks | 100 to 1 | 100 to 1 | 100 to 1 | 100 to 1 |
| 2 one-eyed Jacks | 50 to 1 | 50 to 1 | 50 to 1 | 40 to 1 |
| 2 Jacks | 9 to 1 | 8 to 1 | 7 to 1 | 7 to 1 |
| 1 one-eyed Jack | 3 to 1 | 3 to 1 | 3 to 1 | 3 to 1 |
| 1 Jack | 1 to 1 | 1 to 1 | 1 to 1 | 1 to 1 |
| House edge | 4.62% | 5.82% | 7.01% | 10.65% |
| Hit frequency | 21.44% | 21.44% | 21.44% | 21.44% |
| **Five Decks** | **JM5-01** | **JM5-02** | **JM5-03** | **JM5-4** |
| 3 one-eyed Jacks | 500 to 1 | 500 to 1 | 500 to 1 | 500 to 1 |
| 3 Jacks | 100 to 1 | 100 to 1 | 100 to 1 | 100 to 1 |
| 2 one-eyed Jacks | 50 to 1 | 50 to 1 | 40 to 1 | 40 to 1 |
| 2 Jacks | 9 to 1 | 8 to 1 | 9 to 1 | 8 to 1 |
| 1 one-eyed Jack | 3 to 1 | 3 to 1 | 3 to 1 | 3 to 1 |
| 1 Jack | 1 to 1 | 1 to 1 | 1 to 1 | 1 to 1 |
| House edge | 3.90% | 5.10% | 7.63% | 8.83% |
| Hit frequency | 21.42% | 21.42% | 21.42% | 21.42% |
| **Six Decks** | **JM6-01** | **JM6-02** | **JM603** | |
| 3 one-eyed Jacks | 500 to 1 | 500 to 1 | 500 to 1 | |
| 3 Jacks | 100 to 1 | 100 to 1 | 100 to 1 | |
| 2 one-eyed Jacks | 50 to 1 | 40 to 1 | 30 to 1 | |
| 2 Jacks | 7 to 1 | 7 to 1 | 8 to 1 | |
| 1 one-eyed Jack | 3 to 1 | 3 to 1 | 3 to 1 | |
| 1 Jack | 1 to 1 | 1 to 1 | 1 to 1 | |
| House edge | 5.83% | 9.62% | 12.20% | |
| Hit frequency | 21.41% | 21.41% | 21.41% | |

The payout odds should be lower (because of a higher probability of occurrence of the appearance of Jacks) and the house odds would be lower with the two described variations where all hit cards during a split would be active in the game. In both of those variations, the probability of hit frequency would be higher. Similarly with Spanish 21™, with fewer ranks of cards in the deck (the cards numbered 10 have been removed, but face or court cards remain in the deck), the hit frequency of jacks increases and the house may wish to lower the payouts to compensate for the difference in probabilities. It is possible to keep the payout rate the same in the pay tables, but that would reduce the house edge. It is also possible to provide one pay table for hands where cards are not split and a separate pay table that applies where cards are split for that player.

In allowing these potential variations, the house may adjust the probabilities in its favor by excluding the splitting of player's cards where the first two cards are Aces or cards with counts of 10 (i.e., 10's, Jacks, Queens and Kings). This would still possibly benefit the player, but by allowing the player to split cards that would strategically not be split (e.g., splitting 4's and splitting fives), the probability of losing the underlying game might increase. This is a less preferred embodiment because the strategy of the underlying play of the game might be altered in certain hands, and this is considered undesirable, although it is allowable. The undesirability comes less from the player using these modified rules, but from other players at the table who may feel that the "flow of cards" is being altered by changing strategies.

Among the features that are present in the play of the preferred version of Jack Magic™ blackjack include at least the following elements:

1) The underlying game is blackjack or blackjack variations (e.g., Spanish 21™).
2) A side bet is placed with the underlying game to engage in a separately paying wagering game, e.g., Jack Magic™ blackjack.
3) The separately paying game may not interfere with any underlying strategy in the play of the underlying game or the payout on the underlying game.
4) After placement of the ordinary blackjack wager and the optional side bet wager, two cards are provided to the player (face up) and two cards are provided to the dealer, one of which is face up.
5) The player is paid on the side bet when any one or more of the three exposed cards (the two player cards of a player making the side bet and the dealer's one exposed card) is a specific rank of card according to the rules of the game, e.g., a Jack.
6) There may be different levels of payout amounts depending upon how many Jacks are shown in the three relevant cards, with increased payments for two jacks and then again for three jacks. Additional bonus awards may be made for one-eyed jacks, or multiples of one-eyed jacks (e.g., the highest bonus being for three one-eyed jacks).
7) The payout for the side bet game is preferably paid before the underlying game is continued. The game is played with larger numbers of deck supplies, with 4, 5, 6 or 8 decks to be typically used. The payout is preferably done before play of the underlying game because if the player busts, that player's cards are usually collected before other hands are resolved or played.

The following description will assist in illustrating one method of playing the game of the invention. There are a dealer and two players at a gaming table, Player 1 and Player 2. The dealer deals from a randomly shuffled set of four decks of cards. Player 1 places a wager in the underlying game of $10 and a side bet wager on Jack Magic™ blackjack game of $2, and Player 2 places a wager of $5 on the underlying Blackjack game, but places no wager on the side bet Jack Magic™ blackjack game. The dealer deals initial two-card hands of blackjack in sequence, one card at-a-time as a first card to Player 1 (face up), a first card (face up) to Player two, a first card (face down) to the dealer, a second card (face up) to Player 1, a second card (face up) to Player 2, and a second card (face up) to the dealer. The hands dealt are as follows in a series of game plays:

| Game 1 | |
|---|---|
| Player 1 Hand | 10 and 7 |
| Player 2 Hand | Jack and 6 |
| Dealer hand | Ten exposed |

In the play of this hand, there would be no payout to any player on the Jack Magic™ blackjack game. Only the first player placed the side bet wager on that game, and neither that player's hand (Player 1) nor the dealer's exposed card showed a Jack. The exposed Jack in Player 2's hand is of no consequence to the play of Jack Magic™ blackjack by Player 1. It is possible to envisage a game where the exposure of a Jack in any hand (or other designated card) could provide a payout of a much lower amount, but that is not a rule in the play of this variant of Jack Magic™ blackjack game. After determining that there would be no award for the play of Jack Magic™ blackjack in this hand, the underlying game of Blackjack would continue in a normal manner.

| Game 2 | |
|---|---|
| Player 1 Hand | Jack and 3 |
| Player 2 Hand | Jack and Ace |
| Dealer Hand | Queen (face up) and 9 |

In the play of this hand, Player 1 would receive a bonus payout based on his side bet wager because that player's hand (Player 1) contains a Jack in the first two exposed cards. Again, the exposed Jack in Player 2's hand is of no consequence to the play of the Jack Magic™ blackjack game, because Player 2 did not make the side bet. After paying off the award amount to Player 1, the game of Blackjack would continue in a normal fashion.

| Game 3 | |
|---|---|
| Player 1 Hand | Ace and 10 |
| Player 2 Hand | 3 and 6 |
| Dealer Hand | Jack (face down) and 8 |

In the play of this hand, there would be no Jack Magic™ blackjack award. The position of the dealer's Jack as a face down card precludes that Jack from any effect on the awards in the Jack Magic™ blackjack game. After determining that there would be no award for the play of Jack Magic™ blackjack in this hand, the underlying game of Blackjack would continue in a normal manner.

| Game 4 | |
|---|---|
| Player 1 Hand | 6 and 9 |
| Player 2 Hand | Ace and 2 |
| Dealer Hand | Jack (face up) and Ace |

In the play of this hand, there would be an immediate payout to Player 1 for the Jack Magic™ blackjack game because the dealer's hand has an exposed jack on the first two cards. The fact that the dealer has a blackjack does not affect the Player's ability to win the Jack Magic™ blackjack side bet. Player 2 has not placed the side bet and therefore does not collect on the dealer's Jack. After paying off the Jack Magic™ blackjack wager, all underlying wagers from Player 1 and Player 2 are collected by the house.

| Game 5 | |
|---|---|
| Player 1 Hand | Jack and 4 |
| Player 2 Hand | King and 5 |
| Dealer Hand | Jack (face up) and 7 |

In the play of this hand, Player 1 will receive a larger award for the play of Jack Magic™ blackjack because two Jacks are engaged in the play of the game, one in the hand of Player 1 and one as the exposed card in the dealer's hand. If Player 2 had a Jack as one of the first two cards, that would not have affected the play of Jack Magic™ blackjack, unless the rules specifically allowed for that. Player 2 in this example did not make the side bet. After paying off the award amount to Player 1, the game of Blackjack would continue in a normal fashion.

As noted above, there would be larger bonuses or different bonuses if there were three Jacks exposed in the hand of Player 1 and the dealer's hand (combined), or if the rules paid for one-eyed Jacks (Jack of Hearts and Jack of Spades), if there were two one-eyed Jacks exposed, or if there were three one-eyed jacks were exposed in the deal of the hand of Player 1 and the dealer's exposed card.

In the above description, variations within the generic concept of the invention have been alluded to or described. One of ordinary skill in the art can develop other alternatives or additions within the scope of the invention. For example, special wagering features such as coin accepting slots, proximity detectors, or other wager indicators (particularly for the side bet wager) can be provided on the gaming table for the play of Jack Magic™ blackjack. Progressive bonuses may be designed for use with the appearance of special hands (e.g., three Jacks, three one-eyed Jacks, two one-eyed Jacks, or the like). Such a progressive bonus may be indicated on a special meter. Other options and components may be added to the play of the game without avoiding the underlying generic concepts disclosed in this description and the claims of the invention.

For example, the underlying game could be another casino-style card game such as baccarat, pai gow poker, or a specialty poker game such as Let it Ride® Stud Poker, for example. In the case of Let it Ride, players each receive 3 cards, face down after placing three equal bets. The dealer receives two cards, face down, that serve as common cards for all players. The players are given a chance to view their cards, and are given the option of taking back one of the bets. The dealer turns over the first community card, and the players are then given the opportunity to take back a second one of the bets. The third bet must remain up. The dealer then reveals his second community card, and each player's hand of three cards plus the two community cards is resolved against a pay table. The pay table shows payout odds for each of a predetermined group of winning hands. A side bet of the present invention could be made available for the appearance of one, two, three or four cards of the same cards, i.e.-Jacks, either from the player hand, the dealer common cards or a combination thereof. It is preferred that the layout be modified so that the player's three cards appear on a given area of the layout, and that the order in which the cards are dealt cannot be modified.

In another example, the underlying game is Pai Gow poker. Each player and the dealer receive 7 cards. The players and the dealer "set" their hands, forming a five card hand and a two card hand. A side bet on the occurrence of a designated card, such as a King in the player's two card hand and/or the dealer's 2 card hand could be offered. Or, the designated card may be in the five card hands, or combinations of the five and two card hands. Other casino games such as Baccarat could be played in a manner similar to the blackjack game described in detail above.

What is claimed:

1. A method of playing a wagering card game comprising an underlying card game and an auxiliary card game comprising:

placing at least one wager on the underlying card game;

optionally placing a wager on the auxiliary card game;

dealing a first number of cards to a player;

dealing a second number of cards to the dealer;

displaying at least one of the player's cards;

displaying at least one of the dealer's cards;

wherein if at least one of the displayed player's cards or at least one of the displayed dealer's cards is a card of a specific predetermined rank, paying a player who has placed the optional wager for the occurrence of the at least one card of a specific predetermined rank being displayed in either the exposed card(s) of the dealer's hand and/or the player's hand; and then continuing deal of cards according to the rules of the underlying game and continuing play of the underlying game.

2. The method of claim 1 wherein the underlying game comprises blackjack.

3. The method of claim 1 wherein the first two cards dealt to the player are displayed.

4. The method of claim 1 wherein only one card dealt to the dealer is displayed.

5. The method of claim 2 wherein the first two cards dealt to the player are displayed.

6. The method of claim 2 wherein only one card dealt to the dealer is displayed.

7. The method of claim 2 wherein paying a player who has placed the optional wager is performed and paying is based on a pay table based on the appearance of cards of specific rank on only displayed player's cards and a first displayed dealer's card.

8. The method of claim 2 wherein a pay table having awards that are no greater than those in the following table is used:

| | | | | |
|---|---|---|---|---|
| Fewer Than 4 Decks | | | | |
| 3 Jacks | 100 to 1 | 100 to 1 | 100 to 1 | 100 to 1 |
| 2 one-eyed jacks | 50 to 1 | 50 to 1 | 50 to 1 | 40 to 1 |
| 2 Jacks | 9 to 1 | 8 to 1 | 7 to 1 | 7 to 1 |
| 1 one-eyed jack | 3 to 1 | 3 to 1 | 3 to 1 | 3 to 1 |
| 1 Jack | 1 to 1 | 1 to 1 | 1 to 1 | 1 to 1 |
| Four Decks | | | | |
| 3 Jacks | 100 to 1 | 100 to 1 | 100 to 1 | 100 to 1 |
| 2 one-eyed Jacks | 50 to 1 | 50 to 1 | 40 to 1 | 40 to 1 |
| 2 Jacks | 9 to 1 | 8 to 1 | 9 to 1 | 8 to 1 |
| 1 one-eyed Jack | 3 to 1 | 3 to 1 | 3 to 1 | 3 to 1 |
| 1 Jack | 1 to 1 | 1 to 1 | 1 to 1 | 1 to 1 |
| Six Decks | | | | |
| 3 one-eyed Jacks | 500 to 1 | 500 to 1 | 500 to 1 | |
| 3 Jacks | 100 to 1 | 100 to 1 | 100 to 1 | |
| 2 one-eyed Jacks | 50 to 1 | 40 to 1 | 30 to 1 | |
| 2 Jacks | 7 to 1 | 7 to 1 | 8 to 1 | |
| 1 one-eyed Jack | 3 to 1 | 3 to 1 | 3 to 1 | |
| 1 Jack | 1 to 1 | 1 to 1 | 1 to 1 | |

9. The method of claim 5 wherein only one card dealt to the dealer is displayed.

10. The method of claim 5 wherein paying a player who has placed the optional wager is performed and paving is based on a pay table based on the appearance of cards of specific rank on only displayed player's cards and a first displayed dealer's card.

11. The method of claim 9 wherein paying a player who has placed the optional wager is performed and paying is based on a pay table based on the appearance of cards of specific rank on only displayed player's cards and a first displayed dealer's card.

12. The method of claim 6 wherein paying a player who has placed the optional wager is performed and paving is based on a pay table based on the appearance of cards of specific rank on only displayed player's cards and a first displayed dealer's card.

13. The method of claim 3 wherein paying a player who has placed the optional wager is performed and paying is based on a pay table based on the appearance of cards of specific rank on only displayed player's cards and a first displayed dealer's card.

14. The method of claim 4 wherein paying a player who has placed the optional wager is performed and paying is based on a pay table based on the appearance of cards of specific rank on only displayed player's cards and a first displayed dealer's card.

* * * * *